US012305648B2

(12) United States Patent
Yang

(10) Patent No.: US 12,305,648 B2
(45) Date of Patent: May 20, 2025

(54) ELECTRIC WATER PUMP

(71) Applicants: Hyundai Motor Company, Seoul (KR); Kia Corporation, Seoul (KR)

(72) Inventor: Gyeong Cheol Yang, Gwangju (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 92 days.

(21) Appl. No.: 18/072,037

(22) Filed: Nov. 30, 2022

(65) Prior Publication Data

US 2023/0220846 A1 Jul. 13, 2023

(30) Foreign Application Priority Data

Jan. 10, 2022 (KR) ..... 10-2022-0003446

(51) Int. Cl.
*F04D 13/06* (2006.01)
*F04D 29/42* (2006.01)

(52) U.S. Cl.
CPC ..... *F04D 13/06* (2013.01); *F04D 13/0686* (2013.01); *F04D 29/426* (2013.01)

(58) Field of Classification Search
CPC ..... H02K 5/203
USPC ..... 415/213.1, 214.1
See application file for complete search history.

(56) References Cited

U.S. PATENT DOCUMENTS

| | | | | |
|---|---|---|---|---|
| 2014/0356200 | A1 | 12/2014 | Chan et al. | |
| 2015/0184674 | A1 | 7/2015 | Lee | |
| 2017/0058915 | A1 | 3/2017 | Liang et al. | |
| 2017/0082117 | A1* | 3/2017 | Zhou | F04D 13/06 |
| 2019/0109516 | A1* | 4/2019 | Bernreuther | H02K 9/227 |
| 2021/0083558 | A1* | 3/2021 | Pae | F04D 13/0686 |
| 2021/0164473 | A1 | 6/2021 | Pawellek et al. | |
| 2021/0180610 | A1* | 6/2021 | Hueser | F04D 13/0686 |
| 2021/0267081 | A1* | 8/2021 | Aasen | F16J 15/104 |

FOREIGN PATENT DOCUMENTS

| | | | | |
|---|---|---|---|---|
| EP | 3929446 | A1 * | 12/2021 | F04D 13/0686 |
| JP | 2012-092742 | A | 5/2012 | |
| JP | 2012-241565 | A | 12/2012 | |
| KR | 2008-0028719 | A | 4/2008 | |
| KR | 101080770 | B1 | 11/2011 | |
| KR | 101953787 | B1 | 3/2019 | |
| KR | 102041438 | B1 | 11/2019 | |
| KR | 102141867 | B1 | 8/2020 | |

* cited by examiner

*Primary Examiner* — Kenneth J Hansen
(74) *Attorney, Agent, or Firm* — Fox Rothschild LLP

(57) ABSTRACT

An electric water pump applicable to a cooling device of a fuel cell system is proposed. The electric water pump comprises a pumping part, housed in a pump housing, configured to pump coolant, a motor part, housed in a motor housing coupled to the pump housing, configured to provide power to the pumping part, and a control part, housed in a controller housing coupled to the motor housing, configured to control the motor part. The pump housing and the controller housing comprise an insulating material.

12 Claims, 12 Drawing Sheets

ELECTRIC WATER PUMP

CROSS REFERENCE TO RELATED APPLICATION(S)

The application claims, under 35 U.S.C. § 119(a), the benefit of Korean Patent Application No. 10-2022-0003446, filed Jan. 10, 2022, the disclosure of which is incorporated herein by reference in its entirety.

BACKGROUND

Technical Field

Embodiments of the present disclosure relate to an electric water pump and, more particularly, to an electric water pump that may be applied to a cooling device of a fuel cell system.

Background

A fuel cell system is a device that generates electric energy using a fuel cell, and uses an electrochemical reaction. For example, the fuel cell system of a vehicle may comprise a fuel cell stack that is an electricity generating assembly of unit fuel cells, each comprising a cathode and an anode.

A reaction takes place in the fuel cell stack, and a coolant supply is required for the purpose of cooling to reduce heat generated from the fuel cell stack. Thus, the fuel cell system may be provided with a water pump for circulating the coolant.

As shown in FIG. 1, a water pump 800 may comprise a pump part 810, a motor part 830, and a control part 850. The pump part 810 may be equipped with an impeller, the motor part 830 may be equipped with a motor including a stator and a rotor, and the control part 850 may be provided with a controller configured to control a motor.

As the coolant in the water pump 800 flows from the pump part 810 through an inside of the rotor to the control part 850, a current carrying path, such as path F1, may be formed from an inlet of the water pump 800 along a controller mounting part of the control part 850, a controller housing, and a housing ground part G. In addition, a current carrying path, such as path F2, may be formed from the inlet of the water pump 800 through a motor housing of the motor part 830, the controller housing of the control part 850, and the housing ground part G.

SUMMARY

Accordingly, the present disclosure has been made keeping in mind the above problems occurring in the existing technologies, and an objective of the present disclosure is to provide a water pump configured to block a current carrying path in the water pump, thus improving insulation performance.

The present disclosure is not limited to the above-mentioned objective. Other objectives of the present disclosure will be clearly understood by those skilled in the art from the following description.

In order to achieve the objective of the present disclosure, the present disclosure provides an electric water pump that may comprise a pumping part, housed in a pump housing, configured to pump coolant, a motor part, housed in a motor housing coupled to the pump housing, configured to provide power to the pumping part, and a control part, housed in a controller housing coupled to the motor housing, configured to control the motor part. The pump housing and the controller housing may comprise an insulating material.

The present disclosure provides a water pump configured to block a current carrying path in the water pump by changing the structure of the water pump, thus improving insulation performance.

The effects of the present disclosure are not limited to those described above, and other effects will be clearly recognized by those skilled in the art from the following description.

BRIEF DESCRIPTION OF THE DRAWINGS

The above and other objectives, features, and other advantages of the present disclosure will be more clearly understood from the following detailed description when taken conjointly with the accompanying drawings, in which.

DETAILED DESCRIPTION

Figure 1:
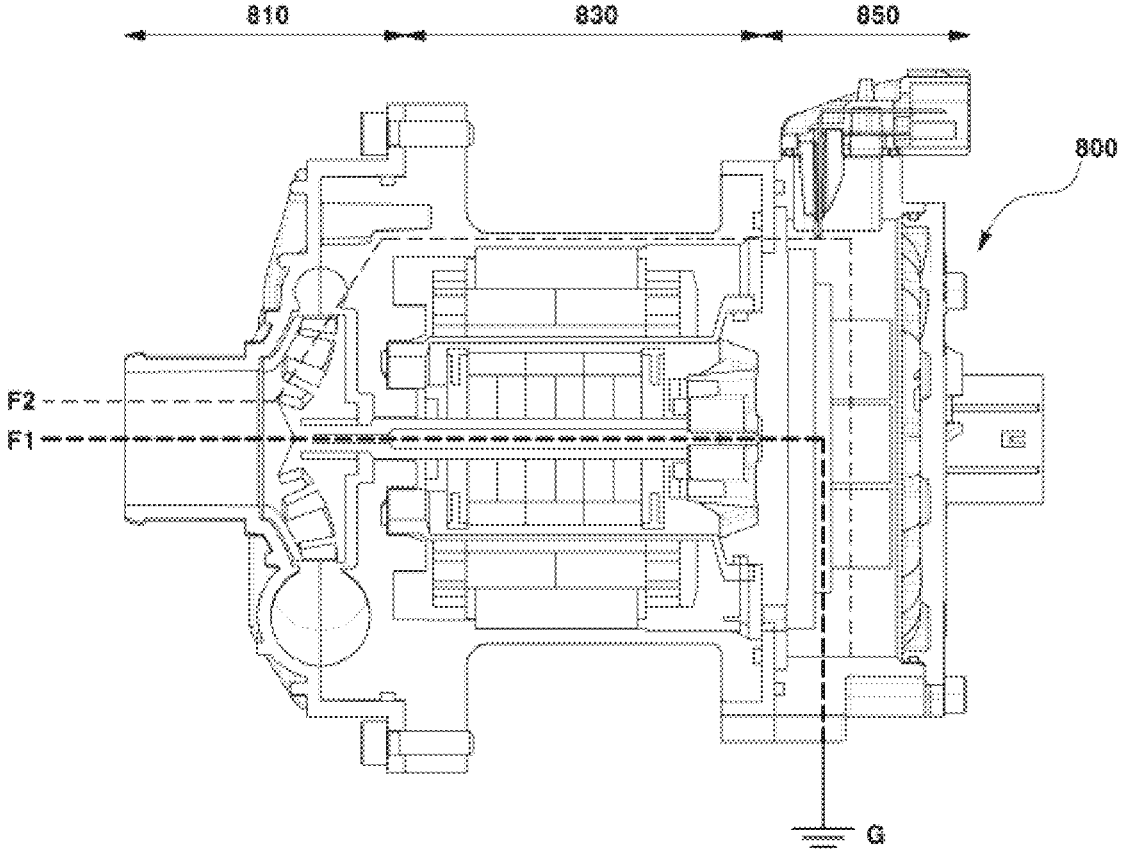
FIG. 1 (Prior Art)
FIG. 1 illustrates a current carrying path of a conventional water pump.

Specific structural or functional descriptions set forth in the embodiments of the present disclosure are only for description of the embodiments of the present disclosure, and embodiments according to the concept of the present disclosure may be embodied in many different forms. The present disclosure should not be construed as being limited to only the embodiments set forth herein, but should be construed as covering all modifications, equivalents or alternatives falling within ideas and technical scopes of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. These terms are merely intended to distinguish one component from another component, and the terms do not limit the nature, sequence or order of the constituent components. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

It will be understood that, although the terms "first," "second," etc., may be used herein to describe various elements, these elements should not be limited by these terms. These terms are only used to distinguish one element from another element. For instance, a first element discussed below could be termed a second element without departing from the teachings of the present disclosure. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between," "directly between," "adjacent to," or directly adjacent to" should be construed in the same way.

Like reference numerals refer to like parts throughout various figures and embodiments of the present disclosure. The terminology used herein is for the purpose of describing particular embodiments only and is not intended to be limiting. In the present disclosure, the singular forms are intended to include the plural forms as well, unless the context clearly indicates otherwise. It will be further understood that the terms "comprise," "include," "have," etc., when used in this specification, specify the presence of stated features, integers, steps, operations, elements, components, and/or combinations of them but do not preclude the presence or addition of one or more other features, integers, steps, operations, elements, components, and/or combinations thereof.

Hereinafter, some embodiments of the present disclosure will be described in detail with reference to the exemplary drawings. In the drawings, the same reference numerals will be used throughout to designate the same or equivalent elements. In addition, a detailed description of well-known features or functions will be ruled out in order not to unnecessarily obscure the gist of the present disclosure.

Referring to FIG. 1, a current carrying path generated like a path F1 or a path F2 increases the possibility of reducing the insulation resistance of a fuel cell system. A reduction in the insulation resistance within the fuel cell system has a significant impact on the performance deterioration of the system. When there are many conductive parts that are in direct contact with coolant and are exposed to an outside, such as an electric water pump 800, the number of current carrying paths is increased. That is, current generated in the fuel cell stack is passed to the conductive part by the coolant. If the number of the current carrying paths in the system is increased, the possibility of reducing the insulation resistance is increased, which may consequently lead to the deterioration of the operating stability and performance of the system.

Moreover, a reduction in the insulation resistance caused by an increase in the ionic conductivity of the coolant may be considered. The fuel cell system is provided with an ion filter to filter ions that are present in the coolant circulating through the system. Unless the ion filter is replaced in time, the ionic conductivity in the coolant is increased. The increased ionic conductivity may increase a current carrying possibility, reduce the insulation resistance, and consequently cause the deterioration of the operating stability and performance of the system.

Thus, the present disclosure seeks to improve the insulation performance of the fuel cell system by blocking the current carrying path through the improvement of the structure of the water pump.

Figure 2A:
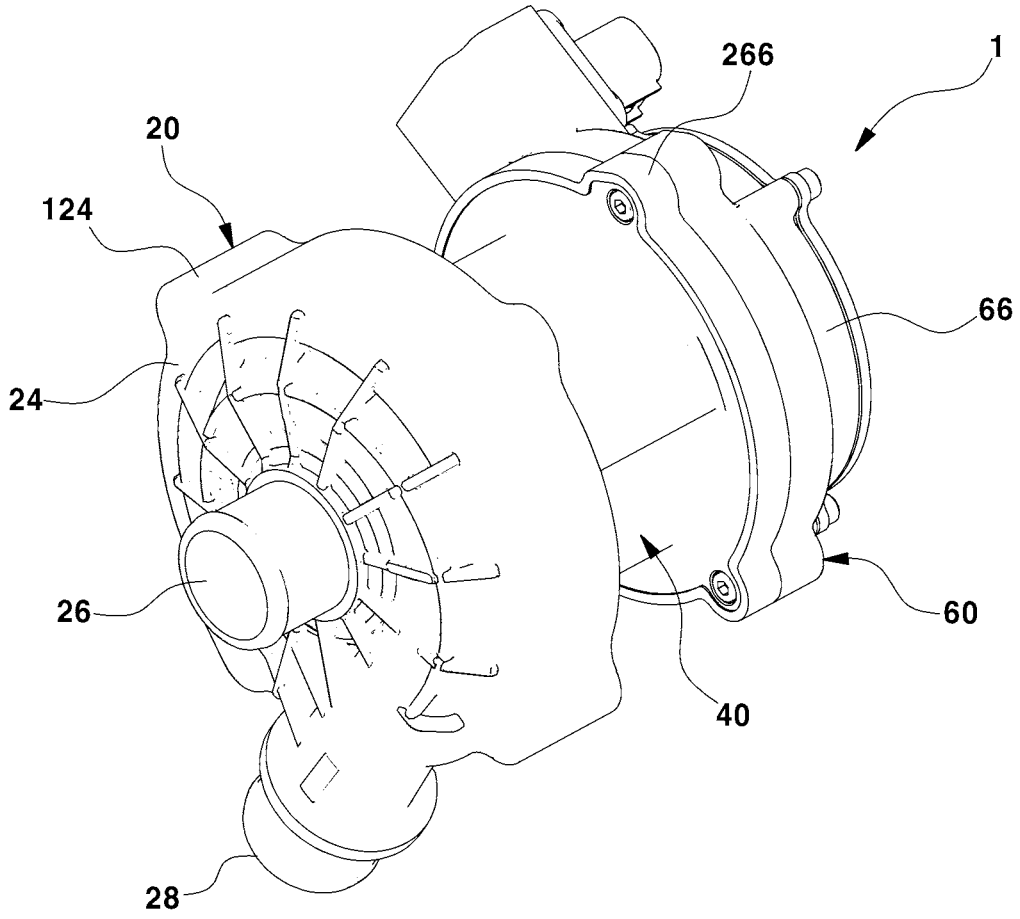
FIG. 2A is a perspective view illustrating a water pump according to an exemplary embodiment of the present disclosure.
Figure 2B:
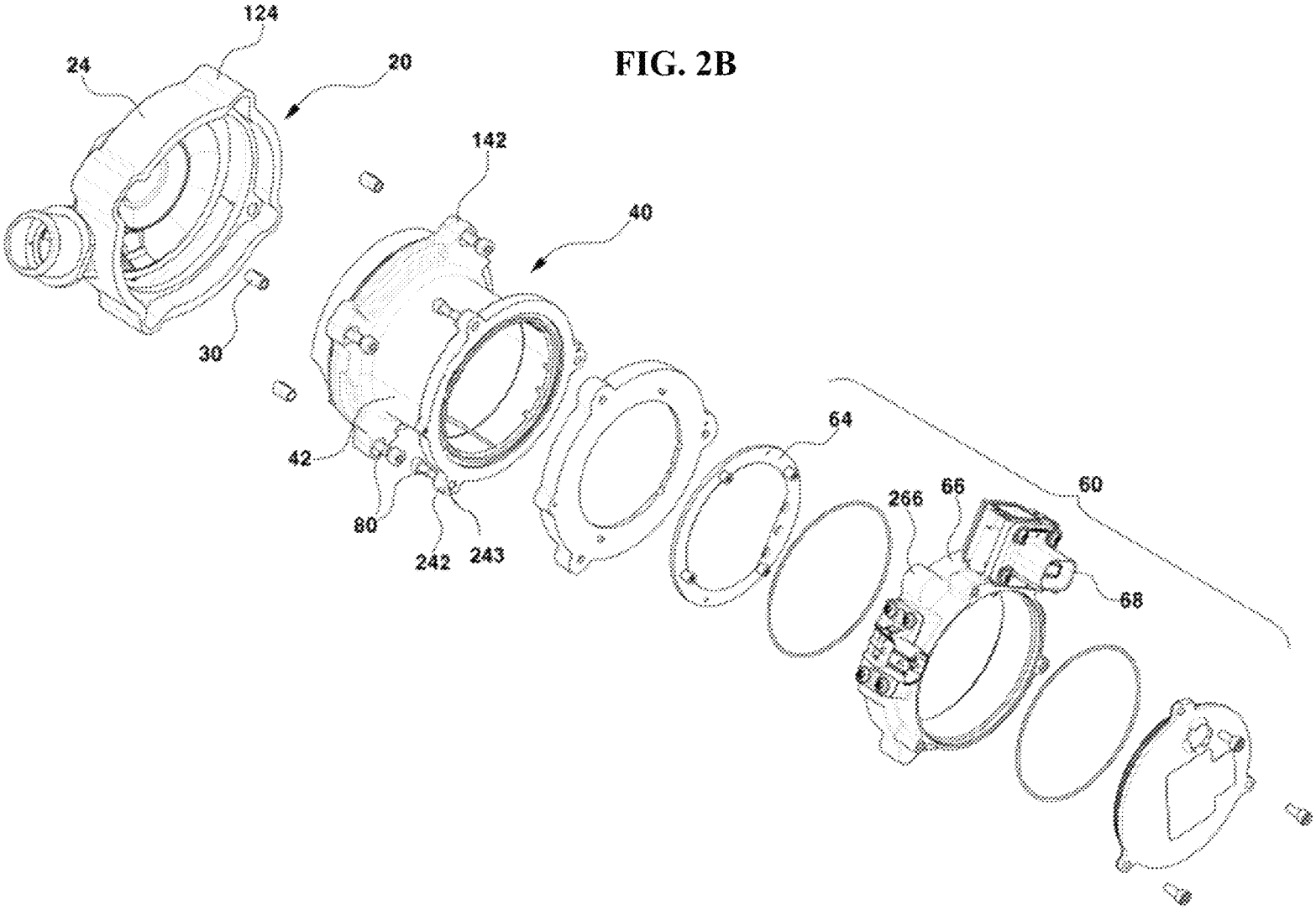
FIG. 2B is an exploded perspective view of FIG. 2A.
Figure 3:
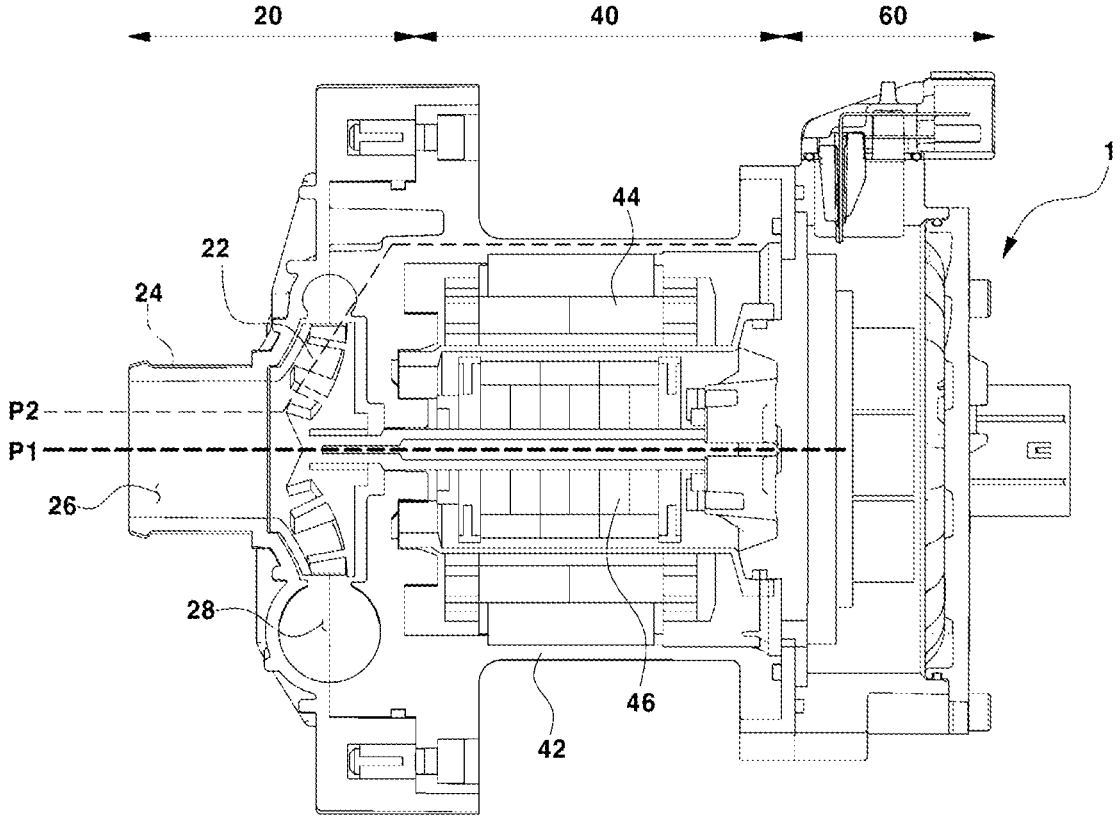
FIG. 3 is a sectional view illustrating the water pump according to an exemplary embodiment of the present disclosure.

As shown in FIGS. 2A, 2B and 3, the water pump 1 according to the present disclosure may comprise a pump part 20, a motor part 40, and a control part 60.

The pump part 20 may be configured to pump the coolant, and may comprise an impeller 22. The pump part 20 may comprise a pump housing 24, and the impeller 22 may be housed in the pump housing 24. According to an exemplary embodiment of the present disclosure, the pump housing 24 may comprise an insulating material. Furthermore, the pump housing 24 may be provided with an inlet 26 into which the coolant is introduced, and an outlet 28 through which the coolant is discharged.

Figure 4:
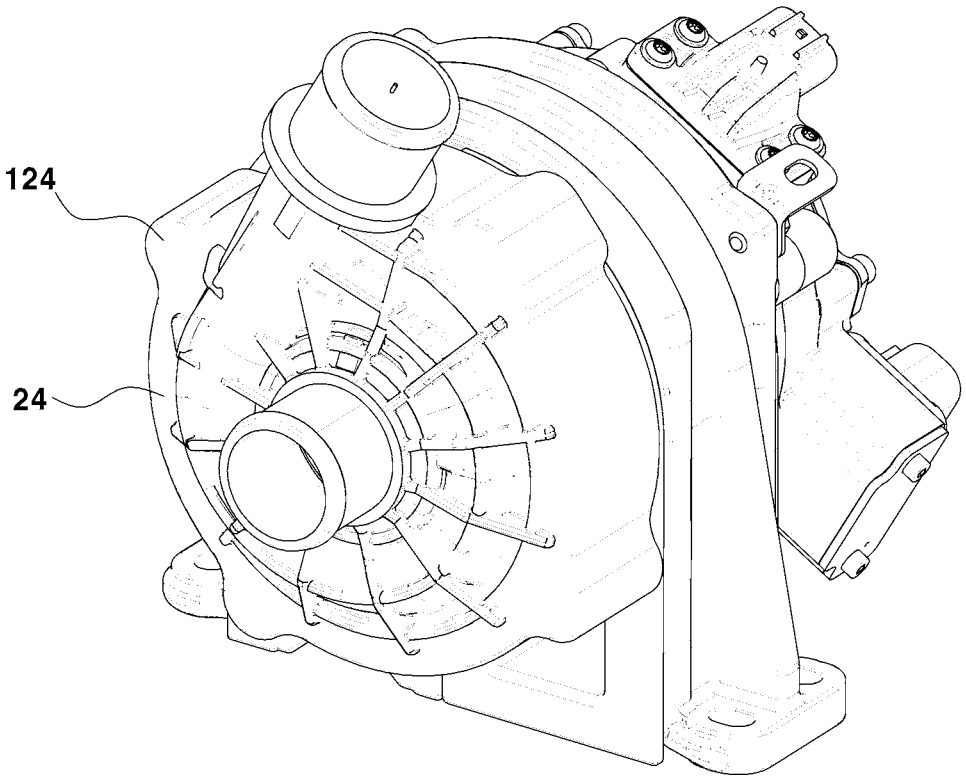
FIG. 4 is a perspective view illustrating a pump-part side when seen from the pump-part side of the water pump according to an exemplary embodiment of the present disclosure.
Figure 5A:
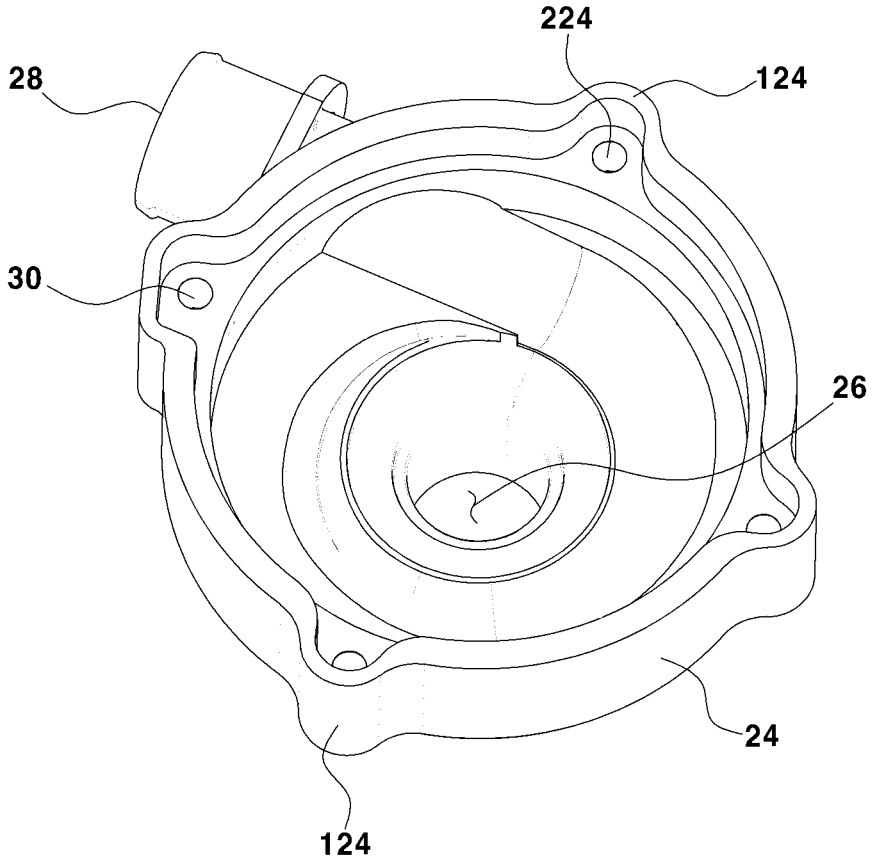
FIG. 5A is a perspective view illustrating a side of a pump housing of the water pump according to an exemplary embodiment of the present disclosure.
Figure 5B:
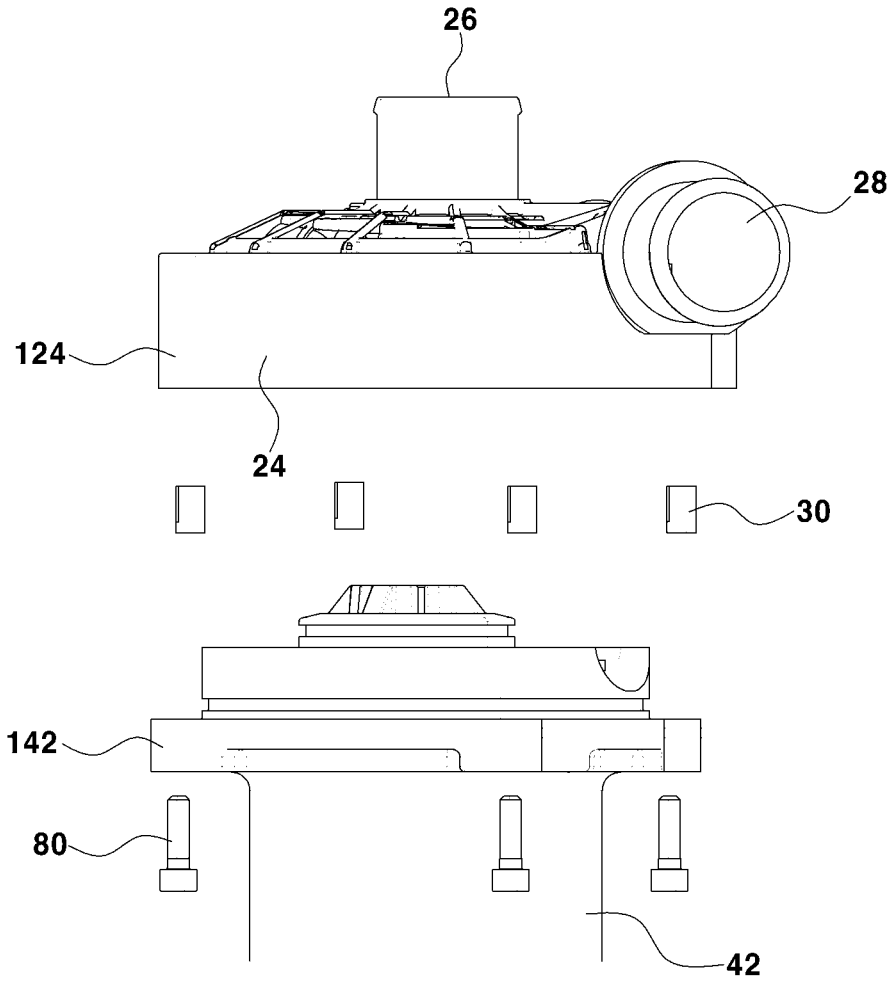
FIG. 5B is an exploded view illustrating a pump part and a motor part of the water pump according to an exemplary embodiment of the present disclosure.

Referring to FIGS. 4, 5A and 5B, the pump housing 24 may be provided with a plurality of coupling parts 124. The coupling parts 124 may be positioned on the circumference of the pump housing 24. The coupling parts 124 may be arranged on the circumference of the pump housing 24 such that the coupling parts 124 may be spaced apart from each other by a predetermined distance. In an exemplary embodiment, each coupling part 124 may extend from the inside of the pump housing 24 outwards in a radial direction. A coupling hole 224 may be provided in the coupling part 124. The coupling hole 224 may be provided in the coupling part 124 so as not to be exposed to the outside of the pump housing 24. According to an exemplary embodiment of the present disclosure, a screw guide 30 may be installed in the coupling hole 224.

Referring to FIGS. 2A, 2B and 3, the motor part 40 may be coupled to the pump part 20. The motor part 40 may be configured to provide a rotating force to the impeller 22. To this end, the motor part may comprise a motor having a stator 44 and a rotor 46, in the motor housing 42. The stator 44 may be disposed on an outside in a radial direction from the central axis of the motor housing 42, and the rotor 46 may be disposed on an inside in the radial direction of the stator 44. Further, the impeller 22 may be configured to be rotatably coupled to the rotor 46.

By coupling the pump housing 24 and the motor housing 42, the pump part 20 and the motor part 40 may be coupled to each other. The motor housing 42 may be provided with a plurality of pump-side connection parts 142 that may be inserted into or connected to the coupling parts 124. The pump-side connection parts 142 may be arranged along the circumference of the motor housing 42 so as to be spaced apart from each other by a predetermined distance, and the number of the pump-side connection parts may be the same as that of the coupling parts 124.

The conventional pump housing 24 and motor housing 42, and one or a plurality of bolts 80 that fasten both the housings to each other, may correspond to conductive parts exposed to the outside. According to the present disclosure, the conductive parts may be positioned such that they are not exposed to the outside by changing the material of pump housing 24 into the insulating material and installing the bolt 80 in a position where it is not exposed to the outside, through the coupling part 124 and the pump-side connection part 142. Therefore, it is possible to prevent the current carrying path from being formed.

According to various embodiments, the pump housing 24 may comprise connection holes 243 configured to be aligned with the coupling holes 224. The plurality of bolts 80 may be mounted from the connection hole 243 towards the coupling hole 224.

The control part 60 may be coupled to the motor part 40. The motor housing 42 may be provided with a controller-side connection part 242. The pump part 20 and the control part 60 may be coupled to opposite sides of the motor part 40. The pump-side connection part 142, formed on one side of the motor part 40, may be coupled to the coupling part 124 of the pump part 20, while the controller-side connection part 242, formed on the other side of the motor part 40, may be coupled to a fastening part 266 of the control part 60.

According to various embodiments, a plurality of controller-side connection parts 242, positioned on the motor housing 42, housed inside the respective fastening part 266, comprises a plurality of connection holes 243 configured to be aligned with the plurality of fastening holes 267. The plurality of bolts 80 may be mounted from the connection holes 243 towards the fastening holes 267.

Figure 6A:
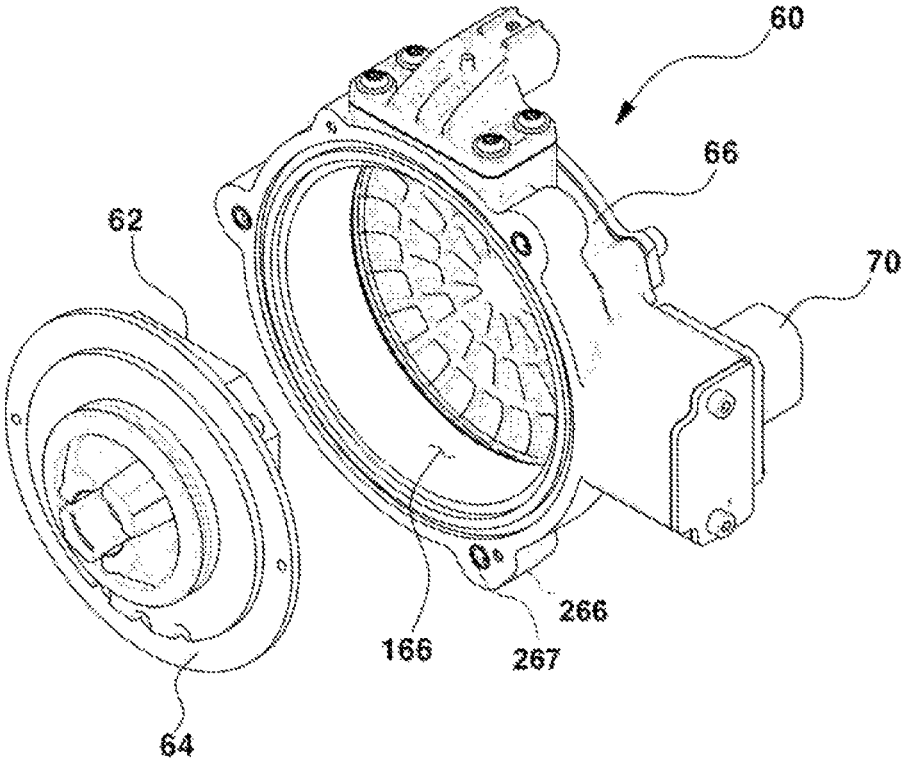
FIG. 6A is an exploded view illustrating a control part of the water pump according to an exemplary embodiment of the present disclosure.

As shown in FIG. 6A, the control part 60 may comprise a controller 62 configured to control the operation of the water pump 1. Furthermore, the control part 60 may comprise a controller seat 64 configured for mounting the controller 62 thereon, and a controller housing 66. According to an exemplary embodiment of the present disclosure, the controller seat 64 and the controller housing 66 may be detachably provided.

To be more specific, the controller 62 may be coupled to and supported on the controller seat 64. In an exemplary embodiment, the controller seat 64 may be formed of a heat dissipation material. The controller seat 64 may be coupled to the controller housing 66 to be detachable from the controller housing 66. In an exemplary embodiment, the controller housing 66 may be provided with a receiving part 166 that receives the controller 62 and is coupled to the controller seat 64.

Figure 6B:
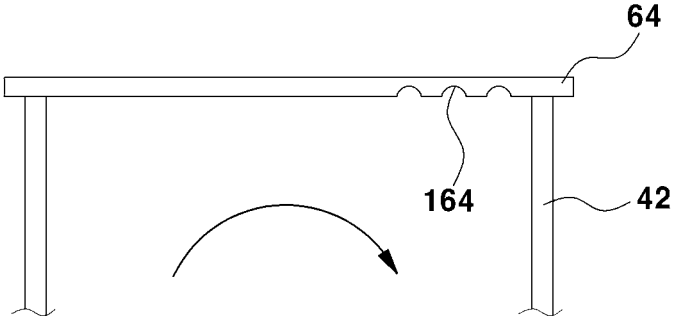
FIG. 6B illustrates a path formed in a controller seat according to an exemplary embodiment of the present disclosure.

The controller housing 66 comprise an insulating material. According to the present disclosure, the controller housing 66 may comprise an insulating material configured to block the current carrying path. However, the control housing may be integrated with the control part, and may be formed of a non-insulating material. The present disclosure, in which the insulating material may be applied to the controller housing 66, may be lower in heat dissipation performance than the conventional integral controller. However, according to the present disclosure, the surface area of an opposite side of the controller seat 64 is increased to prevent the heat dissipation performance from being deteriorated. For example, as shown in FIG. 6B, a plurality of paths 164 may be formed on the opposite side of the controller seat 64, thus increasing a surface area with which the coolant circulates in the motor housing 42, as shown by the arrow contacts, improving the heat dissipation performance.

Figure 7:
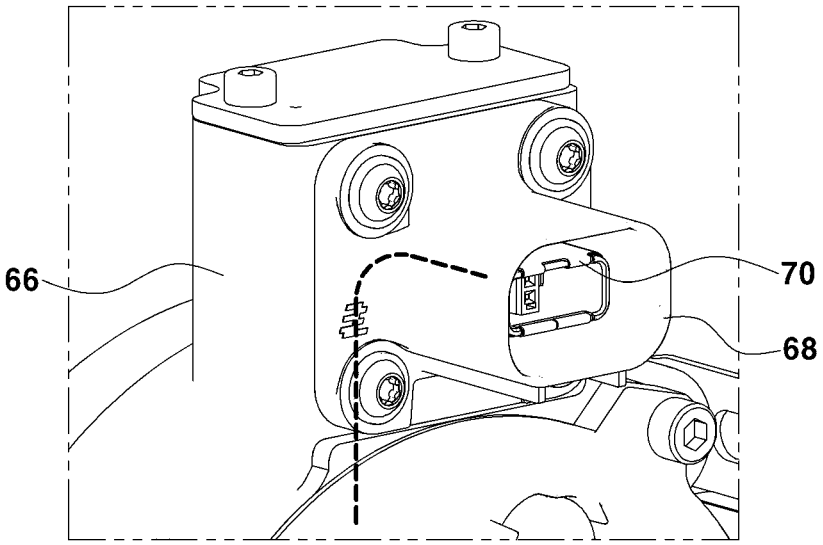
FIG. 7 illustrates a connector of the control part of the water pump according to an exemplary embodiment of the present disclosure.
Figure 8:
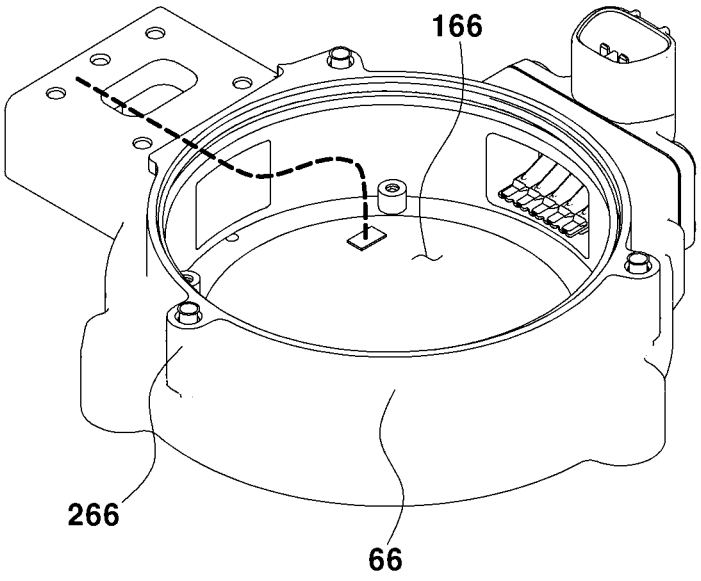
FIG. 8 illustrates a controller housing of the control part of the water pump according to an exemplary embodiment of the present disclosure.

According to the present disclosure, as the controller housing 66 may be formed of an insulating material, the grounding position of the controller 62 may be changed. As shown in FIGS. 7 and 8, the control part 60 may be provided with a high-voltage connector 68 to be electrically coupled to an external device, and the high-voltage connector 68 may be protected by a connector shield 70. According to the present disclosure, the controller 62 may be coupled to and grounded on a side of the connector shield 70. The controller 62 may be grounded by being connected to the side of the connector shield 70 through a path passing through the receiving part 166 and the high-voltage connector 68.

According to the present disclosure, since the controller housing 66 may comprise an insulating material, the grounding position of the controller 62 may be required, unlike the existing technologies. The existing technologies have adopted an external grounding method where the controller housing 66 is grounded. However, the present disclosure applies an internal grounding method to the connector shield 70. Generally, when the relatively simple external grounding structure is changed into the internal grounding structure, a structure may become complicated. However, according to the present disclosure, the grounding may be performed through the side of the connector shield 70, so complexity caused by the change may be minimized. Furthermore, interference with other parts may be avoided by removing a ground wire exposed to the outside.

Figure 9:
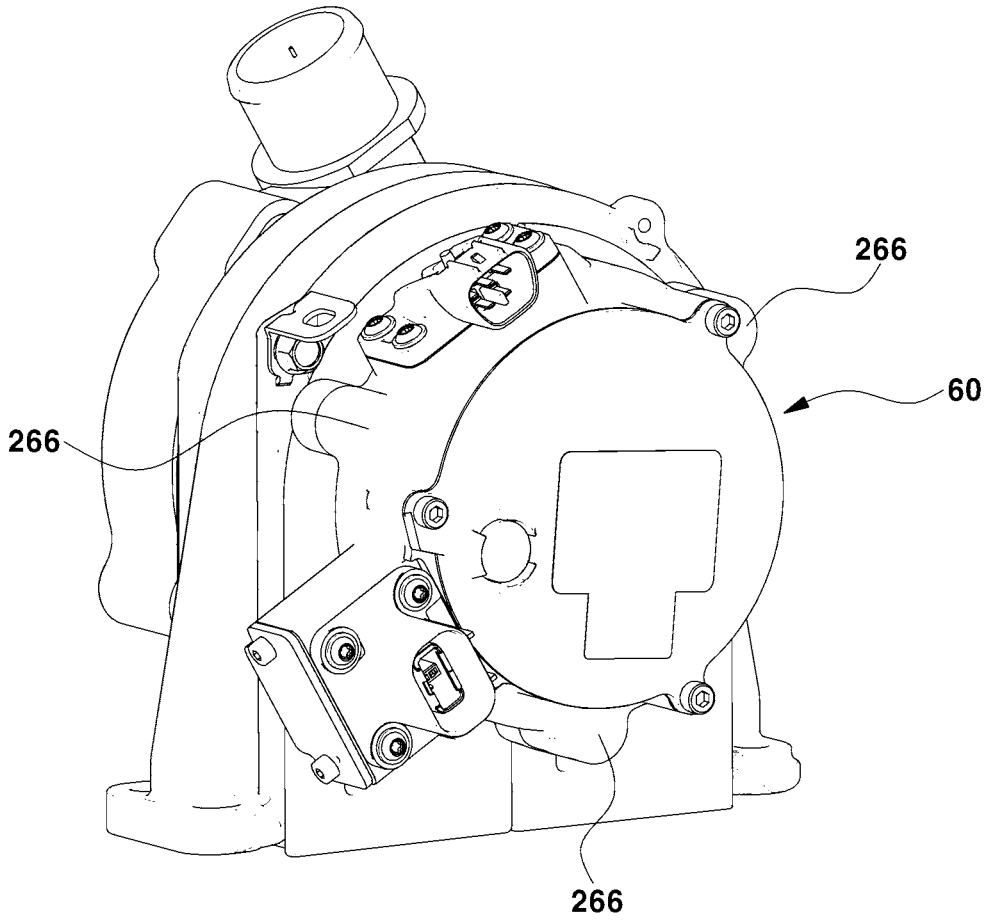
FIG. 9 is a perspective view illustrating a control-part side when seen from the control-part side of the water pump according to an exemplary embodiment of the present disclosure.
Figure 10:
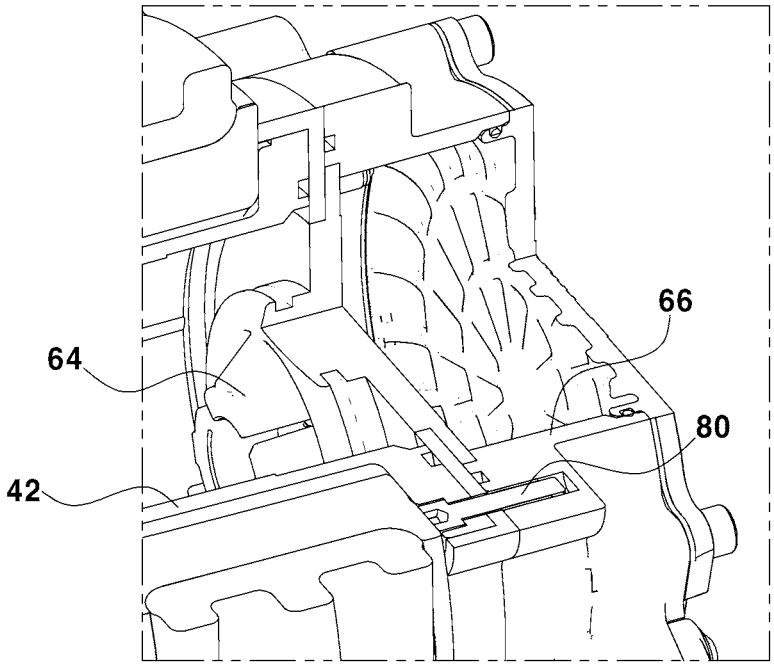
FIG. 10 is a sectional view illustrating a part between the motor part and the control part of the water pump according to an exemplary embodiment of the present disclosure.

Referring to FIGS. 9 and 10, the controller housing 66 may be provided with a plurality of fastening parts 266. The fastening parts 266 may be provided on the circumference of the controller housing 66 so as to be spaced apart from each other by a predetermined distance. In an exemplary embodiment, each fastening part 266 may extend from the inside of the controller housing 66 outwards in a radial direction. Similar to the coupling part 124, a fastening hole may be provided in the fastening part 266. The fastening hole may be provided in the fastening part 266 to be coupled to the bolt 80 without being exposed to the outside of the controller housing 66. In an exemplary embodiment, the screw guide 30 may be installed in the fastening hole. Furthermore, the fastening parts 266 may be provided to be aligned with the controller-side connection parts 242 of the motor part 40, and the number of the fastening parts may be the same as that of the controller-side connection parts 242.

The controller housing 66, the motor housing 42, and the bolt 80 that couples the housings to each other may be conductive parts that are exposed to the outside. According to the present disclosure, the control part 60 may be configured to be divided into the controller seat 64 and the controller housing 66, and the controller housing 66 may comprise an insulating material. Furthermore, in order to prevent the conductive parts from being exposed to the outside, the fastening part 266 and the controller-side connection part 242 may be configured to install the bolt 80 therein.

Thus, turning back to FIG. 3, the current carrying path in the water pump 1 is changed into the path P1 and the path P2. As in the path P1, the current passes through the coolant to the controller seat 64 and the connector shield 70, and the conventional ground part G of the controller housing is eliminated. Further, the path passing through the pump housing 24 is directed through the motor housing 42 to the connector shield 70, and the conventional ground part G of the controller housing is eliminated.

Figure 11:
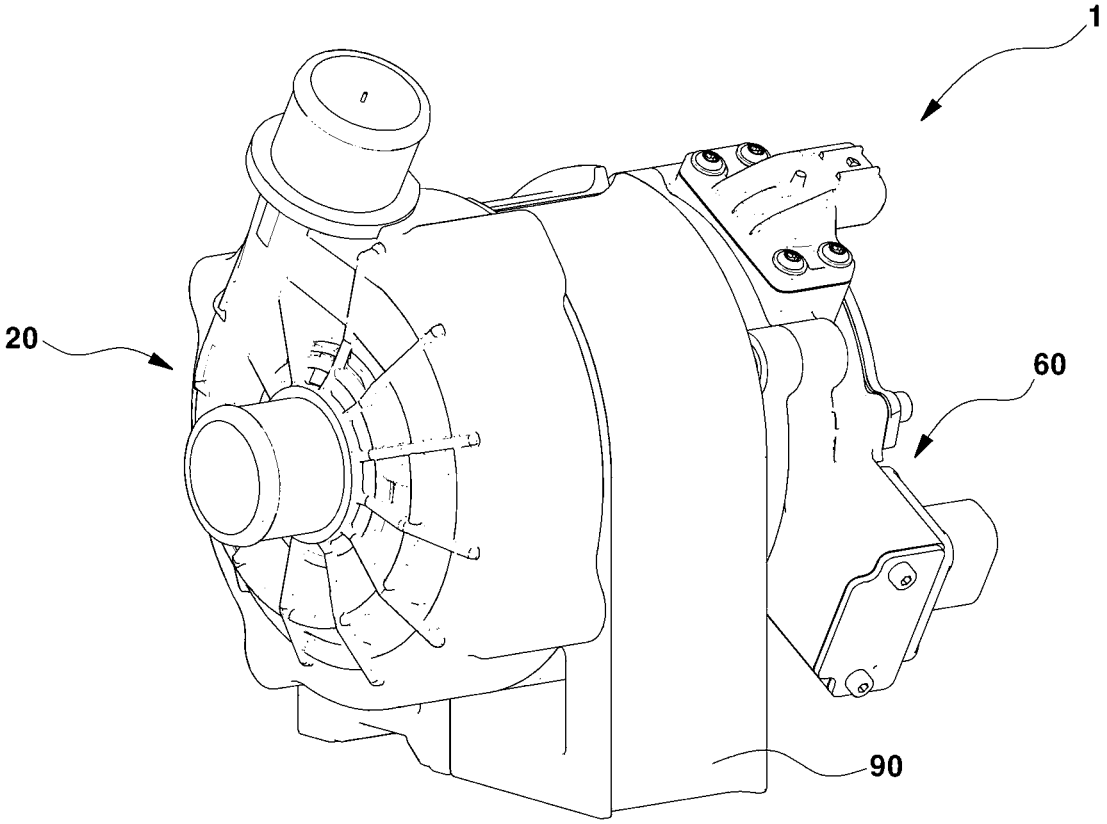
FIG. 11 is a perspective view illustrating the water pump according to an exemplary embodiment of the present disclosure.

As shown in FIG. 11, the water pump 1, according to the present disclosure, may further comprise a bushing 90. The bushing 90 may be formed of an insulating material, such as rubber. If the bushing 90 that is the insulating material is mounted on the motor housing 42, all the conductive parts may not be exposed.

According to the present disclosure, the pump housing 24 and the controller housing 66 may be formed of an insulating material, and the bolt 80 that is the conductive part is not exposed to the outside by the coupling part 124, the pump-side connection part 142, the controller-side connection part 242, and the fastening part 266. That is, parts that are the conductive parts in the conventional water pump are not exposed to the outside, thus improving the insulation performance. The motor housing 42 may be the conductive part, but all the conductive parts may not be exposed by mounting the bushing 90.

Furthermore, according to the present disclosure, the size of the conventional water pump may be reduced. The reason is because the extension of the pump housing 24, the motor housing 42, and the controller housing 66 may be removed by changing the fastening structure of the bolt 80.

Although the present disclosure was described with reference to specific embodiments shown in the drawings, it is apparent to those skilled in the art that the present disclosure may be changed and modified in various ways without departing from the scope of the present disclosure, which is described in the following claims.

What is claimed is:

1. An electric water pump comprising:

a pumping part housed in a pump housing and configured to pump coolant;

a motor part housed in a motor housing coupled to the pump housing and configured to provide power to the pumping part;

a control part housed in a controller housing coupled to the motor housing and configured to control the motor part;

wherein the pump housing and the controller housing comprise an insulating material;

a first plurality of bolts configured to couple the pump housing and the motor housing, wherein the first plurality of bolts are mounted such that the first plurality of bolts are not exposed to an outside of the pump housing and the motor housing;

a coupling part positioned on the pump housing and configured to position a plurality of coupling holes in the pump housing, wherein the plurality of coupling holes are positioned on a circumference of the pump housing and spaced apart from each other by a predetermined distance; and a pump-side connection part positioned on the motor housing and housed inside the coupling part, wherein the pump housing comprises connection holes configured to be aligned with the coupling holes, wherein the first plurality of bolts are mounted from the connection hole toward the coupling hole.

2. The electric water pump of claim 1, further comprising a second plurality of bolts configured to couple the motor housing and the controller housing, wherein the second plurality of bolts are positioned such that the second plurality of bolts are not exposed to an outside of the motor housing and the controller housing.

3. The electric water pump of claim 2, further comprising:

a plurality of fastening parts positioned on the controller housing and configured to position a plurality of fastening holes in the controller housing, wherein the plurality of fastening holes are positioned on a circumference of the controller housing and spaced apart from each other by a predetermined distance; and a plurality of controller-side connection parts positioned on the motor housing and housed inside the respective fastening part, wherein the plurality of controller-side connection parts comprise a plurality of connection holes configured to be aligned with the plurality of fastening holes;

wherein the second plurality of bolts are mounted from the connection holes toward the fastening holes.

4. The electric water pump of claim 1, wherein the control part further comprises a controller seat; detachably coupled to the controller housing and configured to mount a controller, wherein the controller is configured to control the motor part thereon.

5. The electric water pump of claim 4, wherein the controller seat is disposed adjacent to the motor part and comprises a plurality of paths formed on a surface of the controller seat, wherein the surface of the controller seat faces the motor part, and wherein the plurality of paths are recessed from the surface of the controller seat.

6. The electric water pump of claim 4, wherein the controller housing further comprises:

a receiving part configured to receive the controller seated on the controller seat; and a connector shield mounted on the controller housing and configured to protect a voltage connector positioned in the controller housing to connect the controller to an external device;

wherein the controller is grounded to the connector shield through a path passing through the receiving part and the voltage connector.

7. The electric water pump of claim 1, further comprising a bushing mounted on the motor housing to surround an outside of the motor housing, wherein the bushing comprises an insulating material.

8. An electric water pump comprising:

a pumping part housed in a pump housing and configured to pump coolant;

a motor part housed in a motor housing coupled to the pump housing and configured to provide power to the pumping part;

a control part housed in a controller housing coupled to the motor housing and configured to control the motor part, wherein the pump housing and the controller housing comprise an insulating material;

a plurality of bolts configured to couple the motor housing and the controller housing, wherein the plurality of bolts are positioned such that the plurality of bolts are not exposed to an outside of the motor housing and the controller housing;

a plurality of fastening parts positioned on the controller housing and configured to position a plurality of fastening holes in the controller housing, wherein the plurality of fastening holes are positioned on a circumference of the controller housing and spaced apart from each other by a predetermined distance; and a plurality of controller-side connection parts positioned on the motor housing and housed inside the respective fastening part, wherein the plurality of controller-side connection parts comprise a plurality of connection holes configured to be aligned with the plurality of fastening holes;

wherein the plurality of bolts are mounted from the connection holes toward the fastening holes.

9. The electric water pump of claim 8, wherein the control part further comprises a controller seat detachably coupled to the controller housing and configured to mount a controller, wherein the controller is configured to control the motor part thereon.

10. The electric water pump of claim 9, wherein the controller seat is disposed adjacent to the motor part and comprises a plurality of paths formed on a surface of the controller seat, wherein the surface of the controller seat faces the motor part, and wherein the plurality of paths are recessed from the surface of the controller seat.

11. The electric water pump of claim 9, wherein the controller housing further comprises:

a receiving part configured to receive the controller seated on the controller seat; and a connector shield, mounted on the controller housing and configured to protect a voltage connector positioned in the controller housing to connect the controller to an external device;

wherein the controller is grounded to the connector shield through a path passing through the receiving part and the voltage connector.

12. The electric water pump of claim 8, further comprising a bushing mounted on the motor housing to surround an outside of the motor housing, wherein the bushing comprises an insulating material.

* * * * *